US011408620B2

(12) United States Patent
Kim et al.

(10) Patent No.: US 11,408,620 B2
(45) Date of Patent: Aug. 9, 2022

(54) AIR CONDITIONER

(71) Applicant: LG Electronics Inc., Seoul (KR)

(72) Inventors: Changkyum Kim, Seoul (KR); Seongwon Bae, Seoul (KR); Namgyu Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 136 days.

(21) Appl. No.: 16/800,113

(22) Filed: Feb. 25, 2020

(65) Prior Publication Data

US 2021/0003292 A1 Jan. 7, 2021

(30) Foreign Application Priority Data

Jul. 5, 2019 (KR) ..... 10-2019-0081560

(51) Int. Cl.
*F24F 1/0353* (2019.01)
*F24F 1/0314* (2019.01)
*F24F 1/0284* (2019.01)

(52) U.S. Cl.
CPC ..... *F24F 1/0353* (2019.02); *F24F 1/0284* (2019.02); *F24F 1/0314* (2019.02)

(58) Field of Classification Search
CPC ..... F24F 1/0353; F24F 1/0314; F24F 1/0284
See application file for complete search history.

(56) References Cited

U.S. PATENT DOCUMENTS

2017/0007953 A1 1/2017 Lee et al.

FOREIGN PATENT DOCUMENTS

| | | | |
|---|---|---|---|
| JP | 2008101818 | | 5/2008 |
| JP | 2011085288 | | 4/2011 |
| JP | 2014222634 | | 11/2014 |
| JP | 2016176610 | | 10/2016 |
| JP | 2016176610 | A * | 10/2016 |
| KR | 20140134543 | | 11/2014 |
| KR | 1020140134167 | | 11/2014 |
| KR | 2018-0008063 | | 1/2018 |
| KR | 20180008064 | A * | 1/2018 |
| KR | 1020180008064 | | 1/2018 |

OTHER PUBLICATIONS

JP2016176610A Translation (Year: 2016).*
KR-20180008064-A Translation (Year: 2018).*
Extended European Search Report in European Appln. No. 20170390.7, dated Sep. 22, 2020, 4 pages.
International Search Report in International Appln. No. PCT/KR2020/000913, dated Apr. 28, 2020, 3 pages.

* cited by examiner

*Primary Examiner* — Schyler S Sanks
(74) *Attorney, Agent, or Firm* — Fish & Richardson P.C.

(57) ABSTRACT

An air conditioner includes a suction panel including a suction grille that defines a suction port configured to receive air, an heat exchanger and a fan that are positioned within the case, and an ion generator disposed in the suction panel and configured to generate ions in the air received through the suction port. The suction panel defines an installation groove recessed from an upper surface of the suction panel and configured to receive the ion generator therein. The ion generator is accommodated inside the installation groove and configured to provide ions toward the upper surface of the suction panel in an upward direction that defines a preset angle with respect to the suction panel.

20 Claims, 11 Drawing Sheets

AIR CONDITIONER

CROSS-REFERENCE TO RELATED APPLICATIONS

This application claims priority under 35 U.S.C. 119 and 365 to Korean Patent Application No. 10-2019-0081560, filed on Jul. 5, 2019, in the Korean Intellectual Property Office, the disclosure of which is incorporated herein by reference.

FIELD

The present disclosure relates to an air conditioner.

BACKGROUND

An air conditioner is a device that can maintain air in a predetermined space to be in a suitable state according to a usage and purpose. In some examples, the air conditioner may include a compressor, a condenser, an expansion device, and an evaporator, which drive a refrigerant cycle for performing compression, condensation, expansion, and vaporization of refrigerant to thereby cool or heat the predetermined space.

In some cases, the predetermined space may be a place in which the air conditioner is used. For example, when the air conditioner may be disposed in houses and offices, the predetermined space may be an indoor space of a house or a building. When the air conditioner is disposed in a vehicle, the predetermined space may be a passenger compartment.

In some examples, the air conditioner may include an indoor heat exchanger and an outdoor heat exchanger that function as the condenser or the evaporator. The indoor heat exchanger may be installed in an indoor device disposed in the predetermined space, and the outdoor heat exchanger may be installed in an outdoor device disposed out of the predetermined space.

In some cases, air conditioners may provide clean air by removing impurities from air and supply pleasant air to a user. For instance, an air conditioner may include an indoor device including a filter assembly for filtering and suctioning air, and an ion generator disposed in the filter assembly and configured to generate ions. In this case, the ion generator is disposed at the center of an upper side of the filter assembly and generates ions in opposite directions of the filter assembly.

The ion generator of the air conditioner may generate ions in a relatively wide area. In detail, the ion generator may generate ions in a horizontal direction of the filter assembly. The ions may be spread only in an adjacent portion to the filter assembly. In some cases, where ions are generated in a relatively small area, charging efficiency and collection efficiency of impurities in air may be reduced.

In some cases, the generated ions may be accommodated on the filter assembly rather flowing into air. In this case, the filter assembly may be charged and contaminated, and charging efficiency and collection efficiency may be reduced. In some cases, when a region around the ion generator is charged, the ion generator may be unable to generate ions.

In some cases, the ion generator may be installed in a perpendicular direction to the filter assembly in order to generate ions and to spread ions more widely in a wider area.

In some cases, excess ions, which are not coupled to impurities in air, may attach to a wall surface or the like and contaminate the wall surface or the like. For instance, a wall mounted type air conditioner may contaminate a ceiling surface.

SUMMARY

The present disclosure describes an air conditioner including an ion generator installed at a preset angle with respect to a suction panel.

In particular, the present disclosure describes an air conditioner including an ion generator for generating ions at a preset angle with respect to a suction panel in order to generate ions in a wider area and, simultaneously, to prevent or reduce contamination in a region around the air conditioner.

The present disclosure also describes an air conditioner including an ion generator, which may be applied to a general wall mounted type air conditioner.

In some examples, an ion generator may generate ions at a preset angle. In particular, the preset angle may correspond to an angle that is not horizontal and vertical angles.

In some implementations, the ion generator may be inserted into a suction panel and may be directly connected thereto. In some implementations, the ion generator may be configured as a separate module, coupled to the suction panel, and indirectly connected thereto.

According to one aspect of the subject matter described in this application, an air conditioner includes: a case including a suction panel, which includes a suction grille that defines a suction port configured to receive air; an heat exchanger and a fan that are positioned within the case; and an ion generator disposed in the suction panel and configured to generate ions in the air received through the suction port. The suction panel defines an installation groove recessed from an upper surface of the suction panel and configured to receive the ion generator therein. The ion generator is accommodated inside the installation groove and configured to provide ions toward the upper surface in an upward direction defining a preset angle with respect to the upper surface of the suction panel.

Implementations according to this aspect may include one or more of the following features. For example, the installation groove may be defined at a side of the suction grille and have a conic shape having a predetermined diameter across a central axis of the installation groove. In some examples, the central axis of the installation groove may be inclined with respect to the upper surface of the suction panel by the preset angle. In some examples, the ion generator may include a wire that extends along the central axis of the installation groove.

In some implementations, the installation groove may have a conic shape, and the ion generator includes a wire that extends along an axis of the installation groove. A diameter of the installation groove may decrease as the installation groove extends inward from the upper surface of the suction panel. In some examples, the suction panel may define a hole inside the installation groove, where the hole has a size corresponding to an external surface of the wire, and the wire passes through the hole and is connected to a voltage source.

In some implementations, the ion generator includes a wire having an end portion accommodated inside the installation groove and configured to generate ions based on a voltage applied to the ion generator. In some examples, the end portion of the wire may be spaced apart from an internal wall of the suction panel that faces the installation groove.

In some implementations, the case may further include: a coupling panel configured to be attached to a wall surface, where the suction panel extends forward from an upper end of the coupling panel; a discharge panel that extends from a front end of the suction panel to a lower end of the coupling panel, where the discharge panel defines a discharge port configured to discharge air passing through the heat exchanger; and a pair of lateral surface panels that are coupled to the suction panel, the discharge panel, and opposite lateral surfaces of the coupling panel.

In some examples, the ion generator may include a pair of ion generators that are respectively spaced apart from opposite sides of the suction grille and positioned adjacent to the pair of lateral surface panels. In some examples, the ion generator may be disposed at one side of the suction grille and positioned adjacent to the coupling panel.

In some implementations, the ion generator may include: a plurality of wires that are configured to generate ions and that extend in one or more predetermine angles with respect to the suction panel; and a base and a cover that are detachably coupled to each other to define a space configured to accommodate the plurality of wires.

In some examples, the plurality of wires may be installed on the base or the cover and configured to generate and provide ions in different angles from each other with respect to the suction panel and to provide ions in the upward direction of the suction port.

In some implementations, the preset angle may be in a range from 30 degrees to 60 degrees with respect to the upper surface of the suction panel. For example, the preset angle may be equal to 45 degrees with respect to the upper surface of the suction panel.

According to another aspect, an air conditioner includes: a suction panel that defines a suction port configured to receive air; and an ion generator disposed in the suction panel and configured to generate ions in the air received through the suction port. The ion generator includes at least one wire having an end portion configured to generate and provide ions in an upward direction of the suction port in response to a voltage being applied to the ion generator. The at least one wire extends in a direction that defines a preset angle in a range from 30 degrees to 60 degrees with respect to the suction panel.

Implementations according to this aspect may include one or more of the following features or the features described above. For example, the ion generator may be accommodated within the suction panel, and the end portion of the wire may be positioned vertically below an upper surface of the suction panel. In some examples, the suction panel may define an installation groove that is disposed at one side of the suction port and configured to accommodate the ion generator therein.

In some implementations, the installation groove may have a conic shape, where a diameter of the installation groove may decrease as the installation groove extends inward from the suction panel along a central axis that is inclined with respect to the suction panel by the preset angle.

In some implementations, the ion generator may include a plurality of wires that extend in the direction that defines the preset angle with respect to the suction panel.

DETAILED DESCRIPTION

Figure 1:
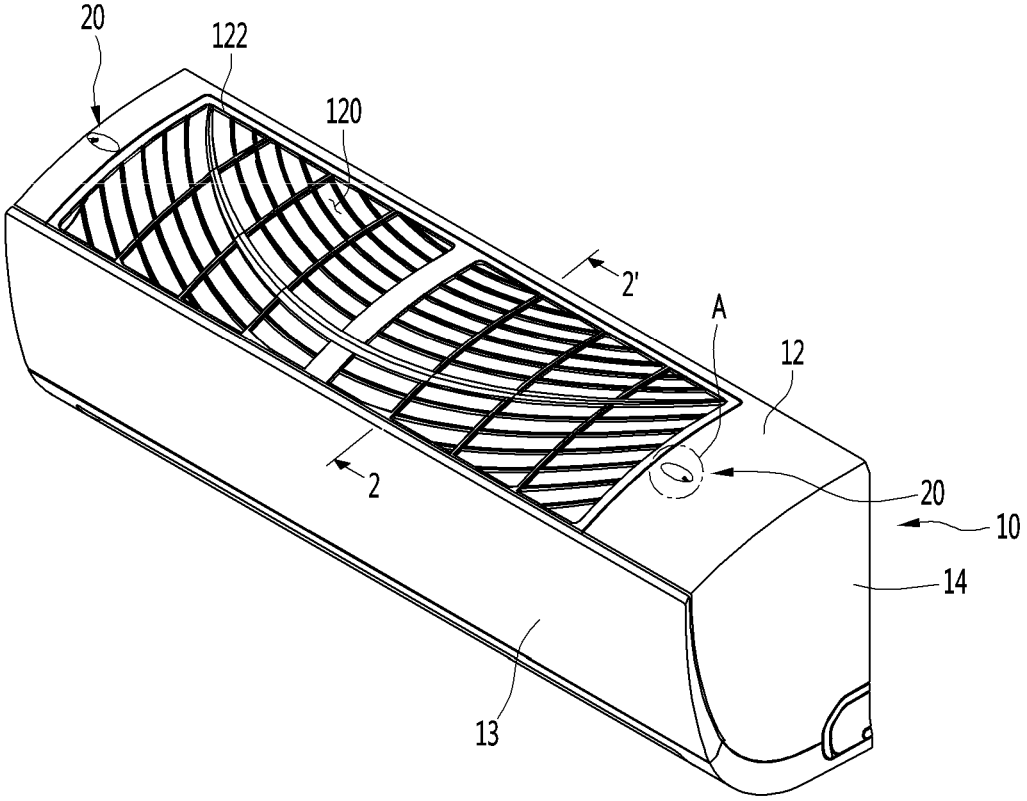
FIG. 1 is a perspective view showing an example of an air conditioner.

Hereinafter, one or more implementations of the present disclosure will be described in detail with reference to the accompanying drawings. In the following description, like reference numerals designate like elements although the elements are shown in different drawings. Further, in the following description, a detailed description of known functions and configurations incorporated herein may be omitted for the purpose of clarity and for brevity.

Figure 2:
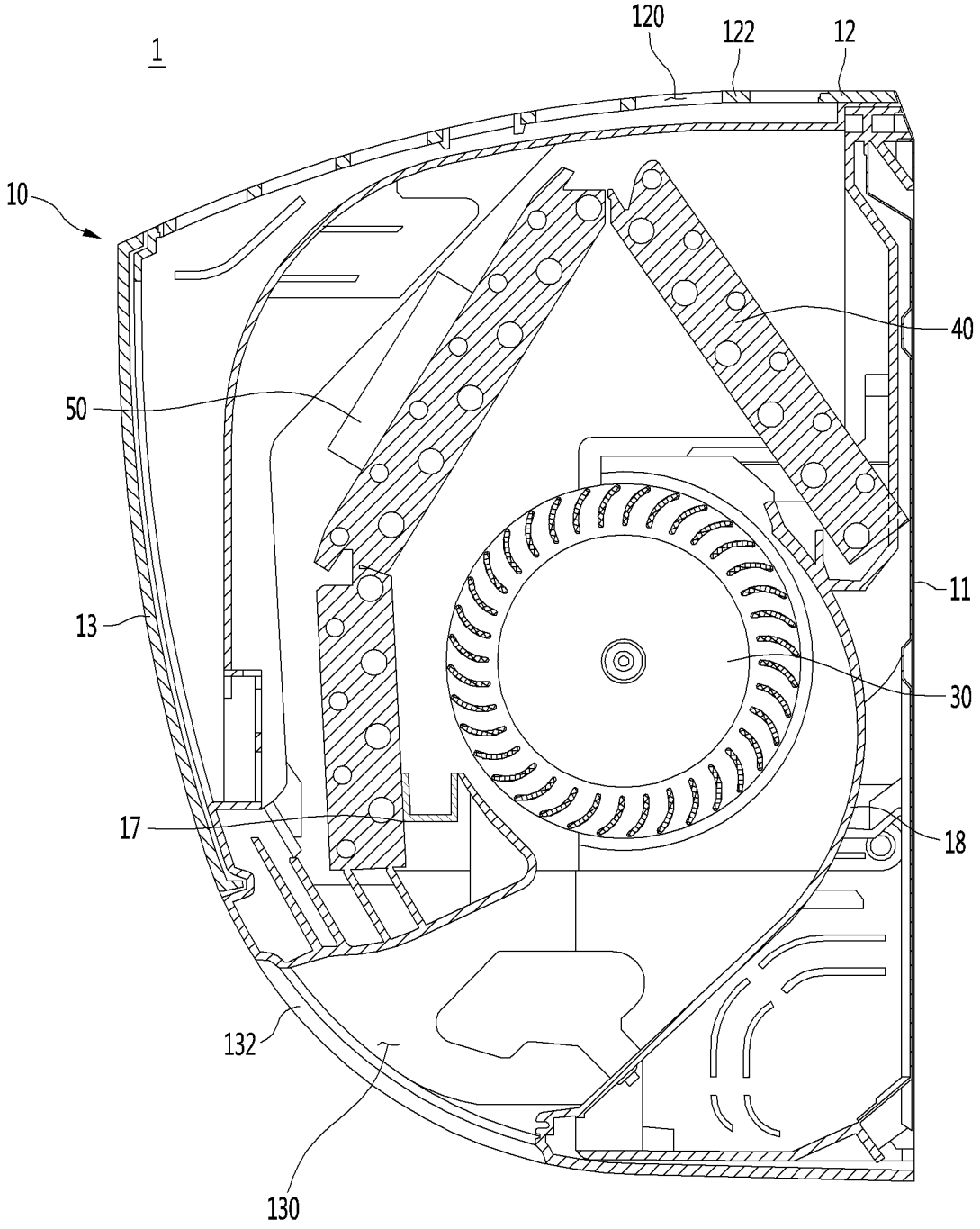
FIG. 2 is a cross-sectional view taken along a line 2-2' of FIG. 1.

FIG. 1 is a perspective view showing an example of an air conditioner, and FIG. 2 is a cross-sectional view taken along a line 2-2' of FIG. 1.

As shown in FIGS. 1 and 2, an air conditioner 1 may correspond to a separation type air conditioner including an indoor device installed in an indoor device installed in an indoor space and an outdoor device connected to the indoor device. In this case, for convenience of description, the outdoor device is omitted. However, this is exemplary, and the air conditioner 1 may correspond to an integration type air conditioner including an indoor device and an outdoor device that are included in a single case.

As shown in FIGS. 1 and 2, the air conditioner 1 may correspond to a wall mounted type air conditioner installed on a wall surface of an indoor space. In particular, the air conditioner 1 may be installed on a lateral wall close to a ceiling surface. However, this is exemplary and the air conditioner 1 may be provided in various shapes.

The air conditioner 1 may include a case 10 that forms an outer appearance and has an internal space. As shown in FIG. 2, the case 10 may have a sectional view with an approximately square shape. As shown in FIG. 1, the case 10 may extend toward one side.

The case 10 may be divided into a coupling panel 11, a suction panel 12, a discharge panel 13, and a lateral surface panel 14. In this case, the panels may be formed to be integrated with each other or may each be formed and may be coupled to each other through a predetermined coupling member or coupling structure. In addition, the panels may be formed to be integrated with each other or may be formed by coupling a plurality of components.

The coupling panel 11 may refer to a panel attached to a wall surface of the indoor space. The coupling panel 11 may be formed as a flat panel to be stably attached to the wall surface. When the air conditioner 1 is installed, the coupling panel 11 is not exposed to the outside and thus may also be referred to as a rear panel.

The suction panel 12 may refer to a panel in which a suction port 120 is formed. The suction panel 12 may extend forward from an upper end of the coupling panel 11. Thus, the suction panel 12 is disposed on an upper portion of the air conditioner 1 and thus may be referred to as an upper surface panel.

The suction port 120 may correspond to an opening through which indoor air is introduced into an internal space of the case 10. The suction panel 12 may include a suction grille 122 by which the suction port 120 is formed. Meshes or the like may be formed in the suction grille 122 in order to prevent introduction of impurities, in detail, relatively large impurities in air.

The discharge panel 13 may refer to a panel in which a discharge port 130 is formed. The discharge panel 13 may extend to be rounded to a lower end of the coupling panel 11 from a lower end of the suction panel 12. Thus, the discharge panel 13 may form a front outer appearance of the air conditioner 1 and may also be referred to as a front panel.

The discharge port 130 may correspond to an opening from which indoor air introduced into the internal space of the case 10 is discharged back to the indoor space. The discharge panel 13 may include a discharge vane 132 that is moveably installed to open and close the discharge port 130. For example, the discharge vane 132 may be opened by rotating a lower portion of the discharge vane 132 in an upward direction.

The lateral surface panel 14 may be configured in one pair and one pair of lateral surface panels 14 may be coupled to opposite side ends of the coupling panel 11, the suction panel 12, and the discharge panel 13.

The air conditioner 1 may include a heat exchanger 40 and a fan 30 that are installed in the case 10.

The heat exchanger 40 may exchange heat with air suctioned by the suction port 120. The heat exchanger 40 may be connected to the outdoor device to form a refrigerant cycle and may function as an evaporator or a condenser. As shown in FIG. 2, the heat exchanger 40 may be disposed to surround a suction side of the fan 30.

The fan 30 may include a cross flow fan for discharge air, which is suctioned in a circumferential direction, in circumferential direction. For example, the fan 30 may include a fixed fan body and a plurality of blades that are fixed to one side of the fan body and are spaced apart from each other in a circumferential direction.

A flow guide 18 that is disposed adjacent to an outer circumferential surface of the fan 30 and is configured to guide flow of air may be installed in the air conditioner 1. The flow guide 18 may smoothly guide suctioned air toward the fan 30 when the fan 30 rotates. The flow guide 18 may prevent air flowing via the fan 30 from being separated from the fan 30.

The air conditioner 1 may include a drain portion 17 that is installed below the indoor the heat exchanger 40 and is configured to store condensed water that is generated during a heat exchange procedure between air and a refrigerant.

In some examples, the air conditioner 1 may include an ion generator 20 for charging impurities in air. The ion generator 20 may refer to a device for generating ions in air along with application of a voltage. The ions generated as such may be coupled to impurities in air and may charge the impurities.

The air conditioner 1 may include a filter device 50 for collecting impurities charged by the ion generator 20. As shown in FIG. 2, the filter device 50 may be installed at one side of the indoor the heat exchanger 40. The filter device 50 may be substituted with the suction grille 122. That is, the suction grille 122 may be configured to collect impurities charged by the ion generator 20.

As shown in FIG. 1, the ion generator 20 may be disposed on the suction panel 12. Hereinafter, the ion generator 20 will be described in detail.

Figure 3:
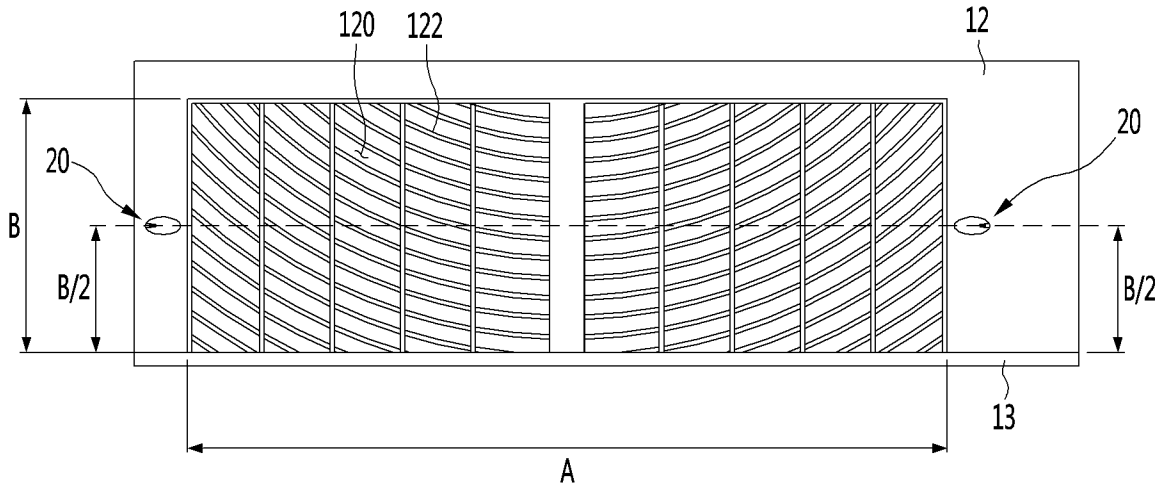
FIG. 3 is a diagram showing an example of a suction side of an air conditioner.

FIG. 3 is a diagram showing an example of a suction panel of an air conditioner. FIG. 3 illustrates an example of an upper view of the air conditioner 1. Accordingly, upper ends of the suction panel 12 and the discharge panel 13 are illustrated.

As shown in FIG. 3, the suction port 120 may be an opening defined in at least a portion of the suction panel 12. That is, the suction grille 122, which defines the suction port 120, may be at least a portion of the suction panel 12.

The suction grille 122 may define the suction port 120 through a plurality of frames, a mesh net, or the like. Referring to FIG. 3, the suction grille 122 may form the suction port 120 by a straight frame that extends in a vertical direction on the drawing and a curved frame rounded in a horizontal direction on the drawing. However, the shape of the suction port 120 formed such as is exemplary and thus is not limited thereto.

In this case, the horizontal direction may be referred to as a first direction, and the vertical direction may be referred to as a second direction. In detail, the first direction may correspond to a direction in which the case 10 extends and may correspond to a direction in which the aforementioned one pair of lateral surface panels 14 are connected to each other. The first direction may correspond to a horizontal direction to a wall surface on which the air conditioner 1 is installed. The second direction may be understood to be a perpendicular direction to the first direction.

The suction grille 122 may be formed like a square with "A" that is a first length extending in the first direction and "B" that is a first length extending in the second direction. In this case, the suction grille 122 may be formed in such a way that the first length A is longer than the second length B (A>B). For example, the first length A may be twice greater than the second length B (A>2*B).

As shown in FIG. 3, the plurality of ion generators 20 may be installed on the suction panel 12. In particular, the ion generator 20 may be disposed at one side of the suction port 120. In detail, the ion generator 20 may be installed outside the suction grille 122, that is, may be formed on a portion of the suction panel 12, in which the suction port 120 is not formed.

In detail, the ion generator 20 may be spaced apart from the suction grille 122. The ion generator 20 may be spaced apart from the suction grille 122 in the first direction. In other words, the ion generator 20 may be disposed between the suction grille 122 and the lateral surface panel 14.

Referring to FIG. 3, the ion generator 20 may be configured in one pair. Accordingly, the one pair of ion generators 20 may be disposed at opposite sides of the first direction, respectively.

The ion generator 20 may be disposed at a central side of the suction grille 122 in the second direction. As seen from FIG. 3, the ion generator 20 may be installed at a line (a line corresponding to B/2) corresponding to the center of the suction grille 122 in the second direction.

Figure 4:
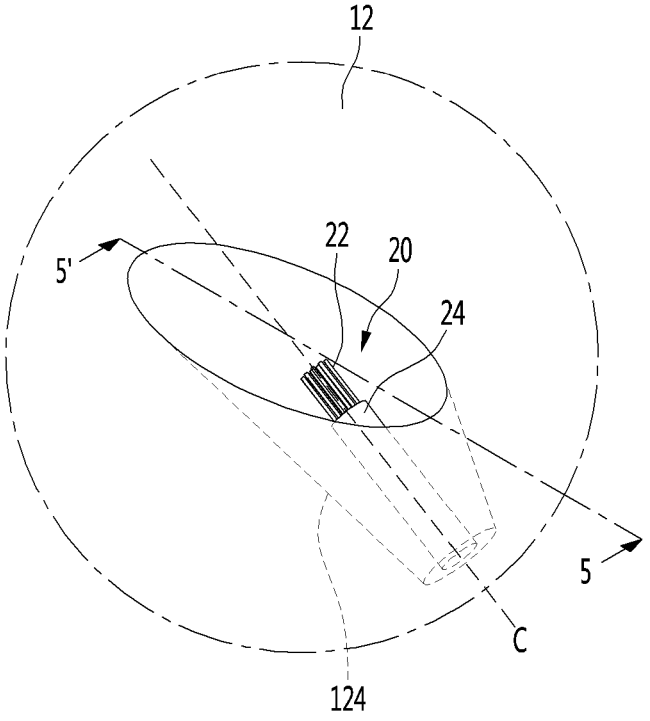
FIG. 4 is a diagram showing a portion A of FIG. 1.
Figure 5:
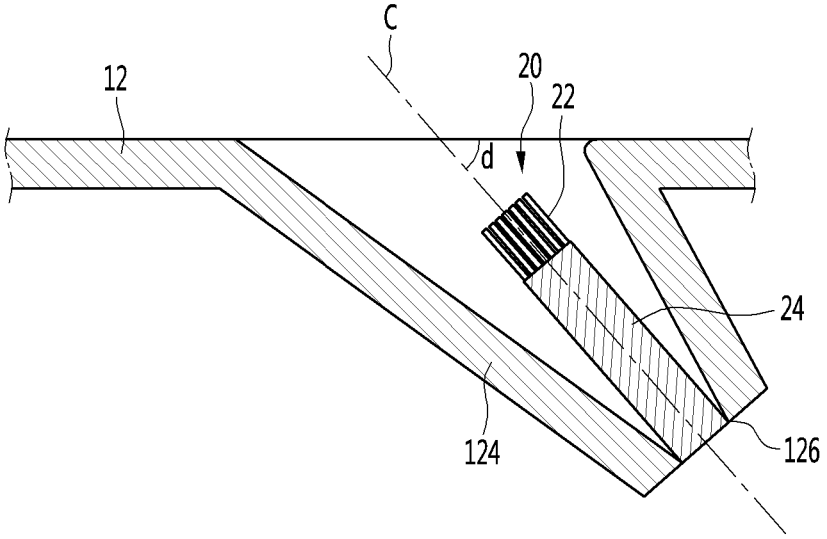
FIG. 5 is a diagram showing an example of an ion generator of an air conditioner.

FIG. 4 is a diagram showing a portion A of FIG. 1. FIG. 5 is a diagram showing an example of an ion generator of an air conditioner.

As shown in FIGS. 4 and 5, the suction panel 12 may include an installation groove 124 in which the ion generator 20 is accommodated. The installation groove 124 may be understood to be a portion of the suction panel 12.

In detail, the installation groove 124 may extend in an internal direction of the case 10 or downward from the suction panel 12 to form a predetermined space. Accordingly, the installation groove 124 may be positioned below the suction panel 12.

In some implementations, the installation groove 124 may have a conic shape having a predetermined diameter based on a central axis C. In detail, the installation groove 124 may be configured with a conic shape, a diameter of which is gradually reduced downward. In some cases, a hole 126 may be formed in one end to which the installation groove 124 extends and which does not form one apex.

In this case, the installation groove 124 may be inclined and may extend at a preset angle d with respect to the suction panel 12. For example, the present angle d is defined with respect to an upper surface of the suction panel 12. That is, the central axis C of the installation groove 124 may define the preset angle d with respect to the suction panel 12. In this case, the suction panel 12 may form with a generally gradual curved surface, but is assumed to be a flat surface shown in FIG. 5 for convenience of description.

Accordingly, the installation groove 124 may have a conic shape that is inclined and extends downward on the suction panel 12. In some examples, as shown in FIG. 4, one end of the installation groove 124 may have an oval shape on the suction panel 12 viewed from the outside. In this case, a major axis of the oval shape may extend in a direction in which the ion generator 20 generates ions. That is, in FIG. 3, the ion generator 20 may generate ions in the first direction.

The ion generator 20 may be installed at the central axis C of the installation groove 124. In detail, the ion generator 20 may include a wire 24 that extends along the central axis C of the installation groove 124. That is, the ion generator 20 may extend to form the preset angle d with respect to the suction panel 12.

The wire 24 may include a carbon brush at an end 22, from which ions are generated as a voltage is applied. The carbon brush may be understood to be a bundle of carbon fibers. Without being limited to, a diameter of the carbon fiber may be in the range of 6.7 micrometers to 7.8 micrometers.

The wire 24 may extend through the hole 126 and may be connected to a device that applies a high voltage. For example, the wire 24 may be connected to a voltage source, a power supply, or a circuit that provides electric power to the wire. For convenience of description, the wire 24 is illustrated up to the hole 126 and the remaining portion is omitted. The hole 126 may have a size corresponding to an external surface of the wire 24. In addition, a member or structure for fixing the wire 24 may be formed in the hole 126 and may fix the wire 24 at a predetermined position.

The ion generator 20 may be installed to be accommodated on the installation groove 124 to prevent the end 22 of the wire 24 from being exposed out of the installation groove 124. That is, the ion generator 20 may be disposed below the suction panel 12. That is, the end 22 of the wire 24 may be positioned in the air conditioner 1.

The ion generator 20 may be configured in such a way that the end 22 of the wire 24 is spaced apart from the installation groove 124. For example, the installation groove 124 may be formed in such a way that a minimum distance between the end 22 of the wire 24 and an internal wall of the installation groove 124 is 5 mm. A portion of the installation groove 124, on which the end 22 of the wire 24 is positioned, may have a diameter of 5 mm or greater.

Through this structure, the ion generator 20 may generate ions to form the preset angle d with respect to the suction panel 12. In this case, the preset angle d may be 30 degrees or more and 60 degrees or less. For example, the preset angle d may correspond to 45 degrees.

With reference to FIG. 3, the case in which the preset angle d is 45 degrees will be described. The ion generators 20 positioned at opposite sides of the suction port 120 may generate ions toward the suction port 120. In particular, the ion generator 20 may generate ions in an upward direction by 45 degrees of the suction port 120.

In this case, there may be a problem in that ions generated by the ion generator 20 are accommodated on a wall surface when the preset angle d is relatively increased. In particular, as described above, the air conditioner 1 is installed on a lateral wall close to a ceiling surface, and thus ions generated by the ion generator 20 may be accommodated on the ceiling surface.

Accordingly, the ceiling surface may be contaminated, and the user may be displeased. As the ceiling surface is charged, charging efficiency may be degraded and removal efficiency of impurities in air may be degraded. That is, as the preset angle d is maintained in a comparatively small angle, for example, 60 degrees or less, ions may be prevented from being accommodated on the ceiling surface.

In some cases, ions generated by the ion generator 20 may not be spread in a wider range when the preset angle d is relatively reduced. That is, ions may flow only in a small area adjacent to the suction panel 12, and thus charging efficiency may be degraded.

The generated ions may be accommodated on the suction grille 122 in air, and charging efficiency may be degraded. The suction grille 122 may be contaminated and the user may be displeased. That is, the preset angle d is maintained in a comparatively large angle, for example, 30 degrees or more, ions may be spread in a wide range.

In summary, as the ion generator 20 generates ions in an upward direction by 45 degrees of the suction port 120, the ceiling surface may be prevented from being contaminated, and simultaneously, ions may be spread in a wider range.

Figure 6:
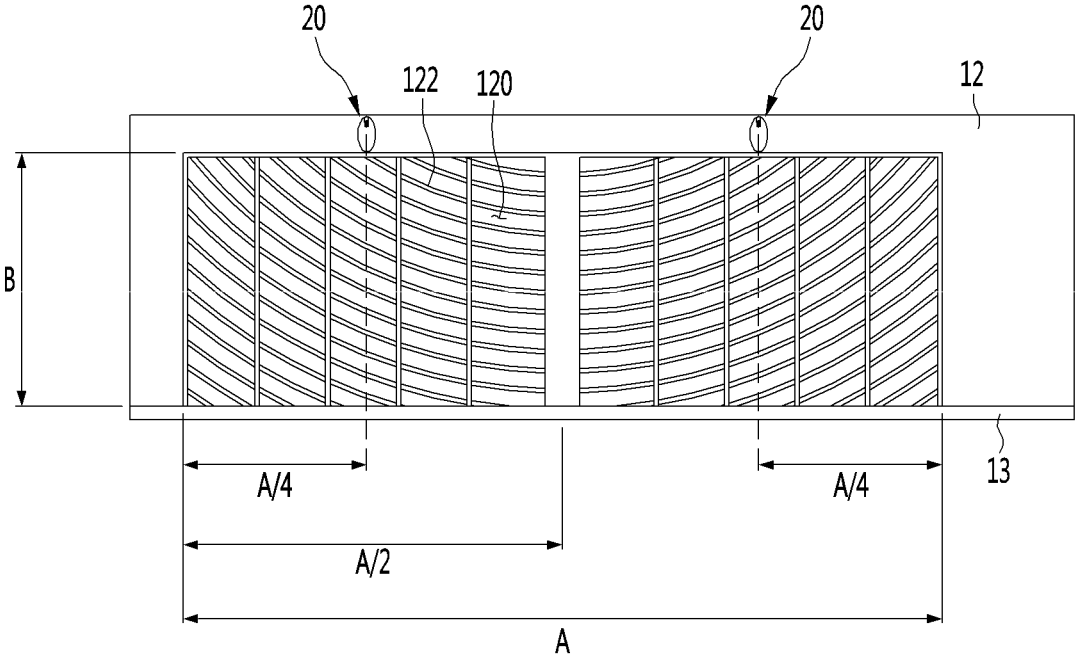
FIG. 6 is a diagram showing an example of a suction panel of an air conditioner.

FIG. 6 is a diagram showing an example of a suction panel of an air conditioner. The air conditioner may be similar to or the same as the air conditioner explained above except for a position of an ion generator. Thus, the above description except for the position of the ion generator is applied, the same reference numerals as the above description are omitted, and thus a description thereof is omitted.

In some implementations, as shown in FIG. 6, the plurality of ion generators 20 may be installed on the suction panel 12. In particular, the ion generator 20 may be disposed at one side of the suction port 120. In detail, the ion generator 20 may be installed outside the suction grille 122, that is, may be formed on a portion of the suction panel 12, in which the suction port 120 is not formed.

In detail, the ion generator 20 may be spaced apart from the suction grille 122. The ion generator 20 may be spaced apart from the suction grille 122 in the second direction. In particular, the ion generator 20 may be disposed between the suction grille 122 and the coupling panel 11.

Referring to FIG. 6, the ion generator 20 may be configured in one pair. The one pair of ion generators 20 may be disposed at one side of the suction grille 122 and may be spaced apart from each other in the first direction. Referring to FIG. 3, the ion generators may be different from the ion generators which are spaced apart from each in the first direction and are disposed at opposite sides of the suction grille 122. The ion generators may be disposed at one side of the suction grille 122 and may be spaced apart from each other in the first direction.

One end of the installation groove 124 may have an oval shape on the suction panel 12. In this case, a major axis of the oval shape may extend in a direction in which the ion generator 20 generates ions. That is, in FIG. 6, the ion generator 20 may generate ions in the second direction.

The ion generator 20 may be disposed at a central side of the suction grille 122 in the first direction. Referring to FIG. 6, the suction grille 122 may have A/2 as a length that extends in the first direction and may be divided into two suction grilles that are disposed in parallel to the first direction. The ion generator 20 may be installed at a central side in the first direction of each grille of the suction grille 122.

In other words, the one pair of ion generators 20 may be spaced apart from opposite ends of the suction grille 122 in the first direction by A/4. In addition, the one pair of ion generators 20 may be disposed together at one side of the suction grille 122 in the second direction. Thus, the one pair of ion generators 20 may generate ions in an upward direction of the suction grille 122.

Figure 7:
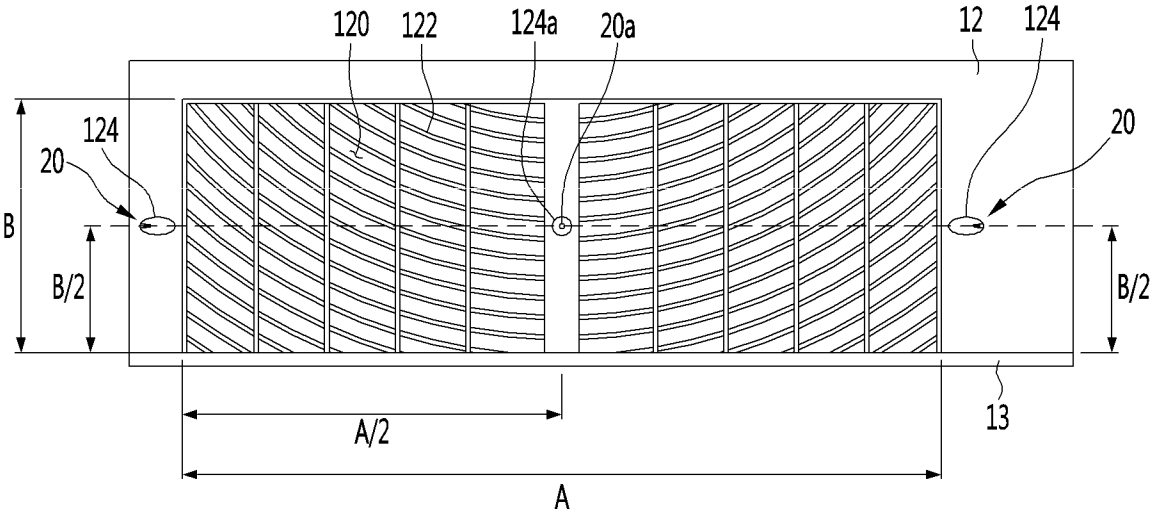
FIG. 7 is a diagram showing an example of a suction panel of an air conditioner.

FIG. 7 is a diagram showing an example of a suction panel of an air conditioner. The air conditioner may be configured by adding an ion generator with a different shape to the air conditioner described above.

Thus, the above description except for the position of the ion generator is applied, the same reference numerals as the above description are omitted, and thus a description thereof is omitted. For clarity, the aforementioned ion generator may be referred to as a first ion generator, and the aforementioned installation groove may be referred to as a first installation groove.

As shown in FIG. 7, the ion generator may include the first ion generator 20 and a second ion generator 20*a*. As described above, the first ion generator 20 may be installed to form the preset angle d with respect to the suction panel 12.

In some implementations, the second ion generator 20*a* may be installed perpendicular to the suction panel 12. That is, the second ion generator 20*a* may generate ions toward a front side of the suction panel 12.

In this case, a high voltage that is smaller than in the case of the first ion generator 20 may be applied to the second ion generator 20*a*. In addition, a time period for which a high voltage is applied to the second ion generator 20*a* may be smaller than a time period for which a high voltage is applied to the first ion generator 20.

That is, the second ion generator 20*a* may generate a smaller amount of ions than in the case of the ion generator 20. In other words, the second ion generator 20*a* may be understood to be an auxiliary ion generator.

As shown in FIG. 7, the second ion generator 20*a* may be disposed between one pair of first ion generators 20. In detail, the second ion generator 20*a* may be disposed between the one pair of first ion generators 20 in the first direction. That is, the second ion generator 20*a* may be disposed at a central side (a point corresponding to A/2) of the suction grille 122 in the first direction.

The second ion generator 20*a* may be disposed at the same line as the one pair of first ion generators 20 in the second direction. That is, the second ion generator 20*a* may be disposed at a central side (a point corresponding to B/2) of the suction grille 122 in the second direction.

The suction panel 12 may include the first installation groove 124 in which the first ion generator 20 is accommodated, and a second installation groove 124*a* in which the second ion generator 20*a* is accommodated.

As described above, the first installation groove 124 may correspond to the first ion generator 20 and may be inclined and may extend at the preset angle d with respect to the suction panel 12. The first installation groove 124 may have a conic shape, a central axis of which forms the preset angle d with respect to the suction panel 12, which extends downward, and a diameter of which is gradually reduced. Accordingly, as shown in FIG. 7, one end of the first installation groove 124 may have an oval shape on the suction panel 12 viewed from the outside.

The second installation groove 124*a* may correspond to the second ion generator 20*a* and may extend perpendicular to the suction panel 12. The second installation groove 124*a* may have a conic shape, a central axis of which is perpendicular to the suction panel 12, which extends downward, and a diameter of which is gradually reduced. Accordingly, as shown in FIG. 7, one end of the second installation groove 124*a* may have a circular shape on the suction panel 12 viewed from the outside.

In summary, the second ion generator 20*a* may be installed at the suction port 120 that is the farthest away from the first ion generator 20. Thus, ions may be more effectively distributed on the suction port 120. However, as described above, the second ion generator 20*a* may be accessorily used to prevent the ceiling surface from being contaminated.

In some implementations, the ion generator of the air conditioner may be inserted into the suction panel and may be directly connected thereto. In some implementations, the ion generator of an air conditioner may be configured as a separate module, coupled to the suction panel, and indirectly connected thereto.

Hereinafter, the above description may be applied except for contradiction, the same reference numerals as the above description are omitted, and thus a description thereof is omitted.

Figure 8:
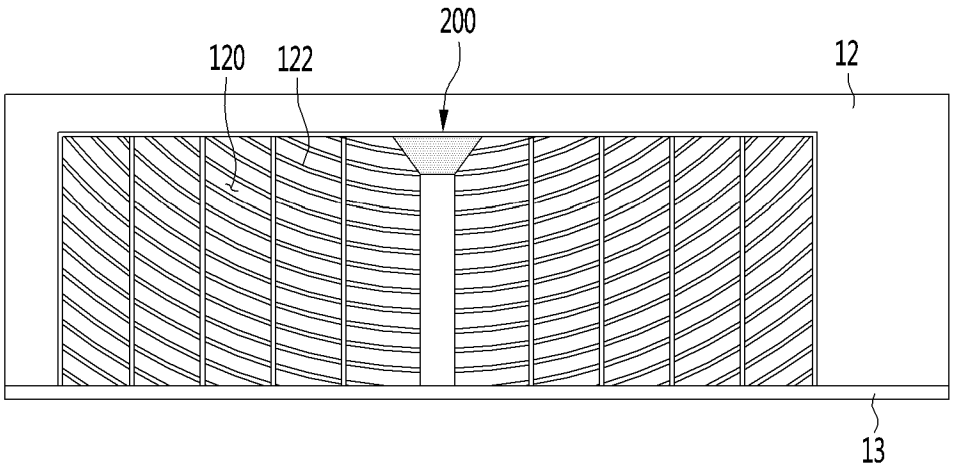
FIG. 8 is a diagram showing an example a suction panel of an air conditioner.
Figure 9:
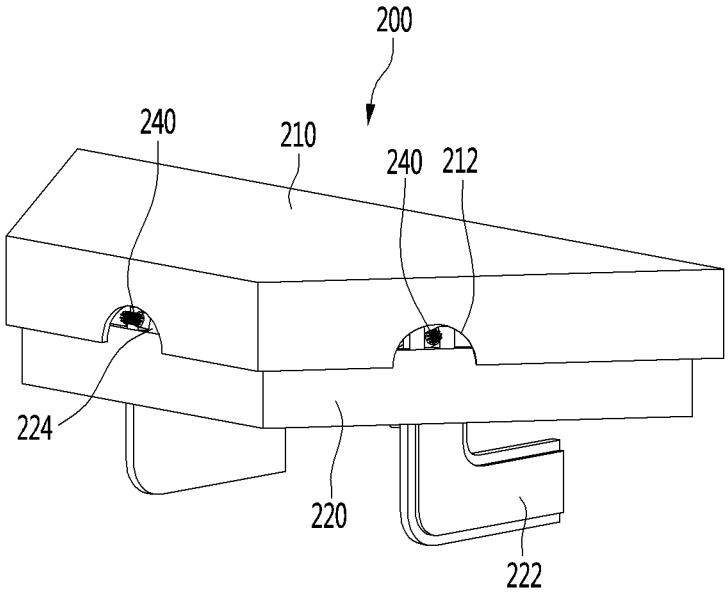
FIGS. 9 to 11 are diagrams showing an example of an ion generator of an air conditioner.
Figure 10:
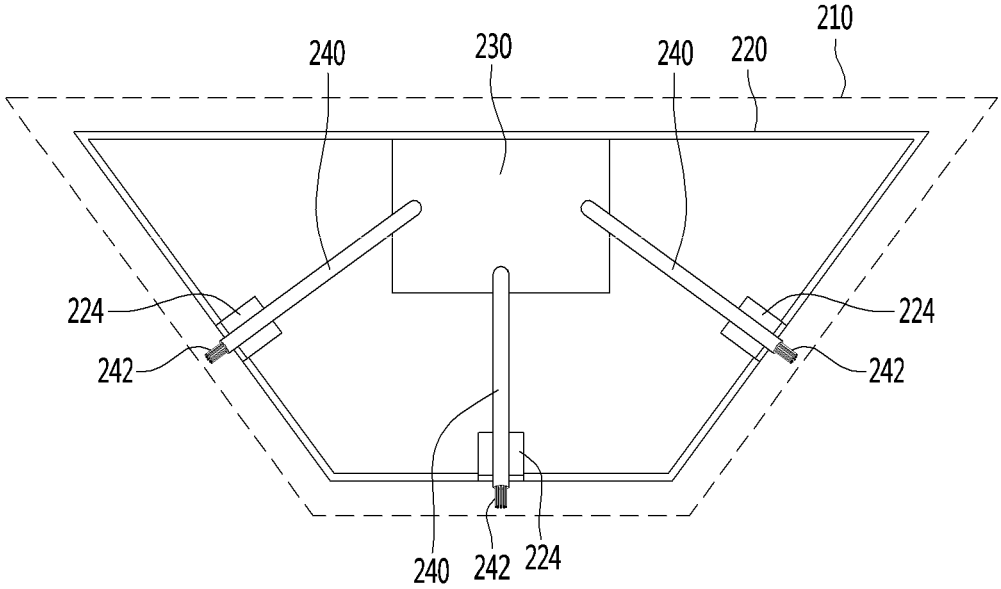
Figure 11:
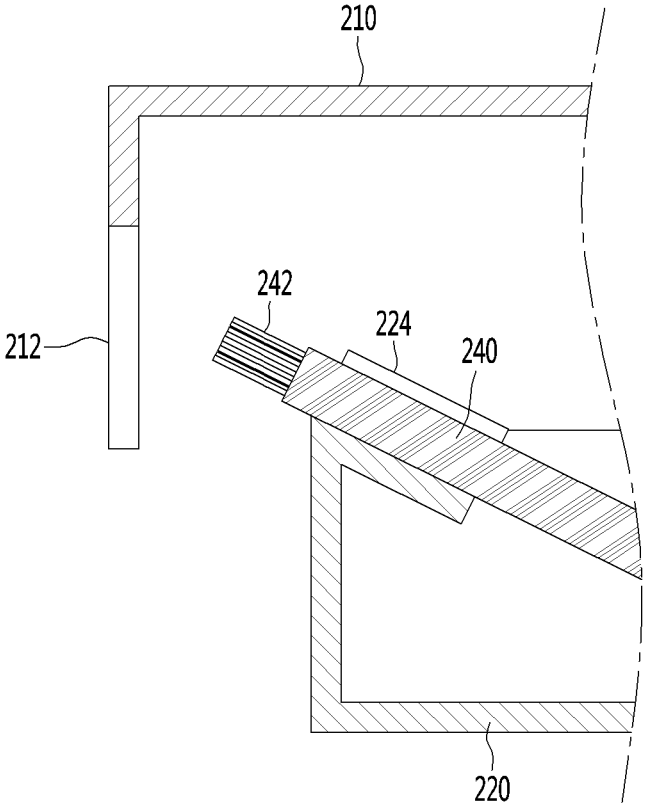

FIG. 8 is a diagram showing an example of a suction panel of an air conditioner. FIGS. 9 to 11 are diagrams showing an example of an ion generator of an air conditioner.

As shown in FIG. 8, an ion generator 200 may be installed on the suction panel 12. In particular, the ion generator 200 may be disposed at one side of the suction port 120. In detail, the ion generator 200 may be detachably installed on the suction grille 122.

The ion generator 200 may include a wire 24 including a carbon brush at an end 242, from which ions are generated as a voltage is applied. In particular, the ion generator 200 may include the plurality of wires 24.

The ion generator 200 may include a base 220 and a cover 210 which accommodate the plurality of wires 24. The ion generator 200 may be configured in a generally polygonal box shape. The base 220 may form lower and lateral surfaces, and the cover 210 may form a lateral surface via overlapping between the upper surface and the base 220.

In particular, the base 220 and the cover 210 may be detachably coupled to each other, and may form a space for accommodating the plurality of wires 24 therein. In this case, the ion generator 200 may be provided to discharge ions generated from the ends 242 of the plurality of wires 24 to the outside.

A coupler 222 that is detachably provided to the suction grille 122 may be configured below a lower surface of the ion generator 200, that is, the base 220. For example, the coupler 222 may be provided in the form of a hook and may be caught and fixed by the suction grille 122.

A position fixer 224 for guiding for a position of the plurality of wires 24 may be provided in the base 220. For example, the position fixer 224 may be provided in a shape of a long groove into which the wire 240 is inserted. In this case, the wire 240 may be inserted into the position fixer 224 to position the end 242 outside the base 220.

The base 220 may include a high voltage applier 230 for applying a high voltage to the plurality of wires 24. That is, the plurality of wires 24 may be connected to the high voltage applier 230 and may receive a high voltage. The ion generator 200 may include the high voltage applier 230 and may be autonomously operated without being connected to a separate power source.

A recess 212, one side of which is opened to correspond to a position of the wire 240, may be formed in the cover 210. The recess 212 may be provided to correspond to the position fixer 224, and ions generated from the end 242 of the wire 240 may be transferred out of the ion generator 200.

In this case, the ends 242 of the plurality of wires 24 may each be installed on a lateral surface of the ion generator 200. For example, as shown in FIGS. 8 to 10, the ion generator 200 may be provided in a trapezoidal shape. The ion generator 200 may include three wires 240, and the ends 242 of the wire 240 may be installed on each surface of the trapezoidal shape.

Accordingly, referring to FIG. 8, the ion generator 200 may be installed at a central side of the suction grille 122 in the first direction. The ion generator 200 may be installed at one end of the suction grille 122, which is adjacent to the coupling panel 11, in the second direction.

The ends 242 of the wires 240 may generate ions in the second direction and a direction that forms a predetermined angle with the second direction. For example, referring to FIG. 10, one of the ends 242 of the three wires 240 may generate ions in the second direction, another end may generate ions in a direction corresponding to rotation of the second direction by 45 degrees, and another end may generate ions in a direction corresponding to rotation of the second direction by −45 degrees.

Referring to FIG. 11, the end 242 of the wire 240 may be inclined and may extend at the preset angle d with respect to the suction panel 12. In this case, the preset angle d may be understood to have the same meaning as in the aforementioned implementations. That is, the end 242 of the wire 240 may generate ions in an upward direction of the suction panel 12.

In summary, the ion generator 200 may include the plurality of wires 24, and the wires 240 may be installed to generate ions in different directions. The end 242 of the wire 240 may be inclined at the preset angle d with respect to the suction panel 12. As such, the ceiling surface may be prevented from being contaminated, and ions may be generated in a wider range.

In some implementations, the ion generators 200 may be configured as a single module, and thus may also be installed in another device, but not the air conditioner 1. For example, the ion generators 200 may be independently installed from the indoor space and may charge impurities in air, and the charged impurities may be collected by a separately provided filter device.

The ion generator may be disposed at a preset angle with the suction panel. That is, the ion generator may generate ions in an upward direction of the suction port. Thus, a region around the air conditioner m y be prevented from being contaminated by excess ions, and simultaneously, ions may be spread in a wider range.

The air conditioner may provide the following effects.

In some implementations, the ion generator may be installed at a preset angle with the suction panel, and thus it may be advantageous that ions are generated in a wider area, and simultaneously, a region around the air conditioner may be prevented from being contaminated.

The ion generator is accommodated in the suction panel, and thus the ion generator may be advantageously protected from external shocks. A user may be prevented from contacting the ion generator, and thus the safety of the user may be advantageously ensured.

It may be advantageous that the ion generator is configured as a separate device and is installed to be independently driven. Thus, it may be advantageous that the ion generator is freely disposed.

What is claimed is:

1. An air conditioner comprising:

a case comprising a suction panel, the suction panel comprising a suction grille that defines a suction port configured to receive air;

an heat exchanger and a fan that are positioned within the case; and an ion generator disposed in the suction panel and configured to generate ions in the air received through the suction port, wherein the suction panel defines an installation groove recessed from an upper surface of the suction panel and configured to receive the ion generator therein, and wherein the ion generator is accommodated inside the installation groove and configured to provide ions toward the upper surface in a direction defining a preset angle with respect to the upper surface of the suction panel, wherein the installation groove is defined at a side of the suction grille, and wherein a central axis of the installation groove is inclined with respect to the upper surface of the suction panel by the preset angle.

2. The air conditioner of claim 1, wherein the installation groove has a conic shape having a predetermined diameter across the central axis of the installation groove.

3. The air conditioner of claim 2, wherein the ion generator comprises a wire that extends along the central axis of the installation groove.

4. The air conditioner of claim 1, wherein the installation groove has a conic shape, wherein the ion generator comprises a wire that extends along an axis of the installation groove, and wherein a diameter of the installation groove decreases as the installation groove extends inward from the upper surface of the suction panel.

5. The air conditioner of claim 4, wherein the suction panel defines a hole inside the installation groove, the hole having a size corresponding to an external surface of the wire, and wherein the wire passes through the hole and is connected to a voltage source.

6. The air conditioner of claim 1, wherein the ion generator comprises a wire having an end portion accommodated inside the installation groove and configured to generate ions based on a voltage applied to the ion generator.

7. The air conditioner of claim 6, wherein the end portion of the wire is spaced apart from an internal wall of the suction panel that faces the installation groove.

8. The air conditioner of claim 1, wherein the case further comprises:

a coupling panel configured to be attached to a wall surface, wherein the suction panel extends forward from an upper end of the coupling panel;

a discharge panel that extends from a front end of the suction panel to a lower end of the coupling panel, the discharge panel defining a discharge port configured to discharge air passing through the heat exchanger; and a pair of lateral surface panels that are coupled to the suction panel, the discharge panel, and opposite lateral surfaces of the coupling panel.

9. The air conditioner of claim 8, wherein the ion generator comprises a pair of ion generators that are respectively spaced apart from opposite sides of the suction grille and positioned adjacent to the pair of lateral surface panels.

10. The air conditioner of claim 8, wherein the ion generator is disposed at one side of the suction grille and positioned adjacent to the coupling panel.

11. The air conditioner of claim 1, wherein the ion generator comprises:

a plurality of wires that are configured to generate ions and that extend in one or more predetermine angles with respect to the suction panel; and a base and a cover that are detachably coupled to each other to define a space configured to accommodate the plurality of wires.

12. The air conditioner of claim 11, wherein the plurality of wires are installed on the base or the cover and configured to generate and provide ions in different angles from each other with respect to the suction panel and to provide ions in the direction defining the preset angle with respect to the upper surface of the suction panel.

13. The air conditioner of claim 1, wherein the preset angle is in a range from 30 degrees to 60 degrees with respect to the upper surface of the suction panel.

14. The air conditioner of claim 1, wherein the preset angle is equal to 45 degrees with respect to the upper surface of the suction panel.

15. An air conditioner comprising:

a suction panel that defines a suction port configured to receive air and an installation groove disposed at one side of the suction port, the installation groove being recessed from an upper surface of the suction panel; and an ion generator disposed in the suction panel and configured to generate ions in the air received through the suction port, the ion generator comprising at least one wire having an end portion configured to generate and provide ions toward the suction port in response to a voltage being applied to the ion generator, wherein the ion generator is accommodated within the installation groove, wherein a central axis of the installation groove is inclined with respect to the upper surface of the suction panel, and wherein the at least one wire extends in a direction that defines a preset angle in a range from 30 degrees to 60 degrees with respect to the upper surface of the suction panel.

16. The air conditioner of claim 15, wherein the end portion of the wire is positioned vertically below the upper surface of the suction panel.

17. The air conditioner of claim 16, wherein the installation groove has a conic shape, and wherein a diameter of the installation groove decreases as the installation groove extends inward from the suction panel along the central axis.

18. The air conditioner of claim 15, wherein the ion generator comprises a plurality of wires that extend in the direction that defines the preset angle with respect to the upper surface of the suction panel.

19. The air conditioner of claim 15, wherein the installation groove has a conic shape extending along the central axis.

20. An air conditioner comprising:

a case comprising a suction panel, the suction panel comprising a suction grille that defines a suction port configured to receive air;

an heat exchanger and a fan that are positioned within the case; and an ion generator disposed in the suction panel and configured to generate ions in the air received through the suction port, wherein the suction panel defines an installation groove recessed from an upper surface of the suction panel and configured to receive the ion generator therein, wherein the ion generator is accommodated inside the installation groove and configured to provide ions toward the upper surface in an upward direction defining a preset angle with respect to the upper surface of the suction panel, and wherein the ion generator comprises a wire having an end portion accommodated inside the installation groove and configured to generate ions based on a voltage applied to the ion generator.

* * * * *